United States Patent [19]

El-Sayed et al.

[11] Patent Number: 4,702,984

[45] Date of Patent: Oct. 27, 1987

[54] POLYBUTYLENE SUCCINIMIDE AS ADJUVANT FOR ELECTROSTATIC LIQUID DEVELOPER

[75] Inventors: Lyla M. El-Sayed, West Chester, Pa.; Arthur J. Taggi, Hockessin, Del.

[73] Assignee: E. I. DuPont de Nemours and Company, Wilmington, Del.

[21] Appl. No.: 857,349

[22] Filed: Apr. 30, 1986

[51] Int. Cl.[4] ..... G03G 9/12

[52] U.S. Cl. ..... 430/115; 430/119

[58] Field of Search ..... 430/115, 119

[56] References Cited

U.S. PATENT DOCUMENTS 3,900,412 8/1975 Kosel ..... 252/62.1
3,976,583 8/1976 Herrmann et al. ..... 430/114
3,990,980 11/1976 Kosel ..... 252/62.1 L
4,032,463 6/1977 Kawanishi et al. ..... 430/114
4,454,215 6/1984 Landa ..... 430/119

*Primary Examiner*—John L. Goodrow

[57] ABSTRACT

Electrostatic liquid developer consisting essentially of (A) nonpolar liquid having a Kauri-butanol value of less than 30, present in a major amount, (B) thermoplastic resin particles a plurality of fibers integrally extending therefrom and having an average by area particle size of less than 10 μm, (C) nonpolar liquid soluble ionic or zwitterionic compound, and (D) charge adjuvant of a polyhydroxy compound, or an aminoalcohol.

(E) colorant, and (F) a polybutylene succinimide.

The electrostatic liquid developers are useful in copying, making proofs including digital color proofs, lithographic printing plates, and resists.

22 Claims, No Drawings

POLYBUTYLENE SUCCINIMIDE AS ADJUVANT FOR ELECTROSTATIC LIQUID DEVELOPER

TECHNICAL FIELD

This invention relates to an electrostatic liquid developer having improved properties. More particularly this invention relates to an electrostatic liquid developer having fibers integrally extending therefrom containing as a constituent a polybutylene succinimide.

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a performed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 $\mu$m average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound of the ionic or zwitterionic type and a charge adjuvant such as a polyhydroxy compound or an aminoalcohol compound to the liquid toner comprising a thermoplastic resin having a plurality of fibers integrally extending therefrom, dispersant nonpolar liquid and colorant. Such liquid toners. while developing good quality images having high resolution with reduced wicking and squash, still do not provide the quality images required for certain end uses, e.g., optimum machine performance in digital color proofing. It has been found that some developer formulations suffer one or more of the following disadvantages which affect image and shelflife: the image formed therefrom suffers from toner flow or beading, the toner charge decays within a short time period, the toner particles in the developer flocculate and settle rapidly.

It has been found that the above disadvantages can be overcome and an improved electrostatic liquid developer prepared containing the above constituents and a polybutylene succinimide. In particular, the image quality is improved due to reduced flow and beading and the shelflife is improved by stabilizing toner charge. This formulation has the further advantages of reduced toner flocculation and settling.

DISCLOSURE OF THE INVENTION

In accordance with this invention there is provided an improved electrostatic liquid developer consisting essentially of (A) a nonpolar liquid having a Kauri-butanol value of less than 30, present in a major amount.

(B) thermoplastic resin particles having a plurality of fibers integrally extending therefrom and an average by area particle size of less than 10 $\mu$m, (C) a nonpolar liquid soluble ionic or zwitterionic compound, (D) a charge adjuvant taken from the group consisting of a polyhydroxy compound and an aminoalcohol compound.

(E) a colorant, and (F) a polybutylene succinimide.

Throughout the specification the below-listed terms have the following meanings:

The electrostatic liquid developer, as defined above consists essentially of the six components more specifically described below. In the claims appended hereto "consisting essentially of" means the composition of the electrostatic liquid developer does not exclude unspecified materials which do not prevent the advantages of the developer from being realized. Additional components, in addition to the primary components, include but are not limited to: fine particle size oxides, metals, etc.

Flow means that large droplets show in the solid areas of the image and there is smearing of fine features.

Smooth means the absence of droplets and smearing of fine features in solids areas.

Beading means that there are large pools of toner in the solid areas of the image and breakage of lines in fine features.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C., Isopar®-M between 207° C. and 254° C., and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |
| Norpar® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C. Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85.0 to 99.9% by weight, preferably 97.0 to 99.5% by weight, based on the total weight of the liquid developer. The total weight of solids in the liquid developer is 0.1 to 15%, preferably 0.5 to 3% by weight. The total weight of solids in the liquid developer is solely based on the resin and pigment components.

Useful thermoplastic resins or polymers include: ethylene vinyl acetate (EVA) copolymers (Elvax ® resins, E. I. du Pont de Nemours and Company, Wilmington, Del.), copolymers of ethylene and an $\alpha,\beta$-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford. Conn.; ethylene vinyl acetate resins, e.g., DQDA 6479 Natural and DQDA 6832 Natural 7 also sold by Union Carbide Corp.: Surlyn ® ionomer resin by E. I. du Pont de Nemours and Company. Wilmington, Del. etc. Preferred copolymers are the copolymer of ethylene and an $\alpha,\beta$-ethylenically unsaturated acid of either acrylic acid or methacrylic acid. The synthesis of copolymers of this type are described in Rees U.S. Pat No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

In addition, the thermoplastic resins have the following preferred characteristics:

1. Be able to disperse the colorant, e.g. pigment.
2. Be insoluble in the dispersant liquid at temperatures below 40° C., so that the resin will not dissolve or solvate in storage.
3. Be able to solvate at temperatures above 50° C.,
4. Be able to be ground to form particles between 0.1 μm and 5 μm, in diameter,
5. Be able to from a particle (average by area) of less than 10 μm, e.g. determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.
6. Be able to fuse at temperatures in excess of 70° C.

By solvation in 3. above, the resins forming the toner particles will become swollen or gelatinous, The thermoplastic resin particles have a plurality of fibers integrally extending therefrom. The preparation of such resin particles is described below.

Suitable nonpolar liquid soluble ionic or zwitterionic compounds (C) include those compounds known in the art as agents that control the polarity of the charge on toner particles (charge directors). Examples of such compounds, which are generally used in an amount of 1 to 1000 mg/g, preferably 1 to 100 mg/g developer solids, are positive charge directors. e.g., sodium dioctylsulfosuccinate (manufactured by American Cyanamid Co.), zirconium octoate and metallic soaps such as copper oleate, etc.; negative charge directors, e.g., lecithin, Basic Calcium Petronate ®, Basic Barium Petronate ® oil-soluble petroleum sulfonate, manufactured by Sonneborn Division of Witco Chemical Corp., New York, N.Y., alkyl succinimide (manufactured by Chevron Chemical Company of California), etc.

The fourth component of the electrostatic liquid developer is a charge adjuvant (D) selected from a polyhydroxy compound or an aminoalcohol compound which are preferably soluble in the developer in an amount of at least 2% by weight. Examples of polyhydroxy compound which contain at least two hydroxyl groups include: ethylene glycol, 2,4,7,9-tetramethyl-5 decyn-4,7 diol, poly(propylene glycol), pentaethylene glycol, tripropylene glycol, triethylene glycol, glycerol, pentaerythritol, glycerol-tri-12 hydroxystearate, propylene glycerol monohydroxystearate, ethylene glycol monohydroxy-stearate, etc. Examples of aminoalcohol compounds which contain at least one alcohol function and one amine function in the same molecule include: triisopropanolamine, triethanolamine, ethanolamine, 3-amino-1 propanol, o-aminophenol, 5-amino-1-pentanol, tetra(2-hydroxyethyl)ethylene-diamine, etc. Component (D) is present in an amount of 1 to 1000 mg/g of developer solids, preferably 50 to 200 mg/g of developer solids.

Still another component of the electrostatic liquid developer is a colorant (E), such as pigments or dyes and combinations thereof. The colorant, e.g., a pigment, present in an amount of about 1 to about 60% by weight based on the weight of total solids in the liquid developer, preferably 1 to 30% by weight based on the weight of total solids in the liquid developer. The amount of colorant may vary depending on the use of the developer. Examples of pigments are Monastral ® Blue G (C.I. Pigment Blue 15 C.I. No. 74160), Toluidine Red Y (C.I. Pigment Red 3), Quindo ® Magenta (Pigment Red 122), Indo ® Brilliant Scarlet (Pigment Red 123, C.I. No. 71145), Toluidine Red B (C.I. Pigment Red 3), Watchung ® Red B (C.I. Pigment Red 48), Permanent Rubine F6B13-1731 (Pigment Red 184), Hansa ® Yellow (Pigment Yellow 98), Dalamar ® Yellow (Pigment Yellow 74, C.I. No. 11741), Toluidine Yellow G (C.I. Pigment Yellow 1), Monastral ® Blue B (C.I. Pigment Blue 15), Monastral ® Green B (C.I. Pigment Green 7), Pigment Scarlet (C.I. Pigment Red 60), Auric Brown (C.I. Pigment Brown 6), Monastral ® Green G (Pigment Green 7), Carbon Black, Cabot Mogul L (black pigment C.I. No. 77266) and Stirling NS N 774 (Pigment Black 7, C.I. No. 77266).

Fine particle size oxides, e.g., silica, alumina, titania, etc.; preferably in the order of 0.5 μm or less can be dispersed into the liquefied resin. These oxides can be used alone or in combination with the colorants. Metal particles can also be added.

The sixth component of the electrostatic liquid developer is a polybutylene succinimide (F). This component is soluble in the nonpolar liquid. Suitable copolymers of this type are commercially available compounds which may differ in molecular weight. One compound is known under the tradename OLOA ®-1200 sold by Chevron Corp. Analysis information of OLOA ® 1200 appears in Kosel U.S. Pat. No. 3,900,412, column 20, lines 5 to 13, incorporated herein by reference. The polybutene of about 70 carbon atoms is attached to a succinic acid group which is reacted with diethylene triamine to provide the basic anchoring group. OLOA ®-1200 is supplied as a 50% weight solution in a mineral oil. It can be deoiled by adsorption from toluene onto silica with elution by acetone. Another copolymer of this type is manufactured by Amoco and is sold commercially as Amoco 575 which is said to have a number average molecular weight of about 600 (determined by vapor pressure osmometry) and is made by reacting maleic anhydride with polybutene to give an alkenylsuccinic anhydride which in turn is reacted with a polyamine. Amoco 575 is 40 to 45% surfactant, 36% aromatic hydrocarbon and the remainder is oil. Component (F) is present in an amount of 5 to 500 mg/g of developer solids, preferably 25 to 200 mg/g of developer solids.

The particles in the electrostatic liquid developer have an average by area particle size of less than 10 μm, preferably the average by area particle size is less than 5 μm. The resin particles of the developer are formed having a plurality of fibers integrally extending therefrom. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media for dispersing and grinding, Ross double planetary mixer manufactured by Charles Ross and Son, Hauppauge, N.Y. etc., are placed the above-described ingredients. Generally the resin, dispersant nonpolar liquid and optional colorant are placed in the vessel prior to starting the dispersing step. Optionally the colorant can be added after homogenizing the resin and the dispersant nonpolar liquid. Polar additive can also be present in the vessel, e.g., 1 to 99% based on the weight of polar additive and dispersant nonpolar liquid. The dispersing step is generally accomplished at elevated temperature, i.e., the temperature of ingredients in the vessel being sufficient to plasticize and liquefy the resin but being below that at which the dispersant nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to ~13 mm).

Suitable polar liquids which have a Kauri-butanol value of at least 30 include: aromatic hydrocarbons of at least 6 carbon atoms, e.g., benzene, toluene, naphthalene, other substituted benzene and naphthalene compounds; monohydric, dihydric and trihydric alcohols of 1 to 12 carbon atoms and more, e.g., methanol, ethanol, butanol, propanol, dodecanol, etc., ethylene and other glycols, Cellosolve; etc.

After dispersing the ingredients in the vessel, with or without a polar additive present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid: or with stirring to form a viscous mixture and grinding by means of particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time. In a grinding time of about 2 hours or less using polar liquid, particles in the average size (by area) of 0.1 to 5 μm are achieved.

After cooling and separating the dispersion of toner particles from the particulate media. if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 3 percent by weight, preferably 0.5 to 2 weight percent with respect to the dispersant nonpolar liquid. One or more nonpolar liquid soluble ionic or zwitterionic compounds, of the type set out above, are added to impart a positive or negative charge, as desired. The addition may occur at any time during the process. If a diluting dispersant nonpolar liquid is also added, the ionic or zwitterionic compound can be added prior to, concurrently with, or subsequent thereto. If the charge adjuvant compound of the polyhydroxy or aminoalcohol type has not been previously added in the preparation of the developer, it can be added subsequent to the developer being charged. Preferably a charge adjuvant is present during the dispersing step. The polybutylene succinimide is preferably added to the liquid developer in concentrated form after completion of grinding in the mixing or blending vessel, e.g., added as an about 10% by weight solution in nonpolar liquid, or to the diluted, e.g., 2% by weight, liquid developer, e.g., added as an about 10% by weight solution in nonpolar liquid. The polybutylene succinimide may be added prior to or after addition of component (C). A preferred mode of the invention is described in Example 4.

INDUSTRIAL APPLICABILITY

The electrostatic liquid developers of this invention demonstrate improved image quality such as improved resolution, image transfer and/or shelflife over liquid toners containing standard charge directors or other known additives. The developers of this invention are useful in copying, e.g., making office copies of black and white as well as various colors: or color proofing, e.g., a reproduction of an image using the standard colors: yellow, cyan, magenta together with black as desired. In copying and proofing the toner particles are applied to a latent electrostatic image.

Other uses are envisioned for the electrostatic liquid developers include: digital color proofing, lithographic printing plates, and resists.

EXAMPLES

The following controls and examples wherein the parts and percentages are by weight illustrate but do not limit the invention. In the examples the melt indices were determined by ASTM D 1238, Procedure A, the average particle sizes by area were determined by a Horiba CAPA-500 centrifugal particle analyzer as described above, the conductivity was measured in picomhos (pmho)/cm at 5 hertz and low voltage, 5 volts, and the density was measured using a Macbeth densitometer model RD 918. The resolution is expressed in the Examples in line pairs/mm (1p/mm).

EXAMPLE 1

In a Union Process 1-S Attritor, Union Process Company, Akron, Ohio, was placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Heucophthal Blue G XBT-583D Heubach, Inc., Newark, NJ | 14.0 |
| Dalamar ® yellow pigment YT-858D Heubach, Inc., Newark, NJ | 0.15 |
| Ethylene glycol (EG) | 13.3 |
| Isopar ®-L, nonpolar liquid having a Kauri-butanol value of 27, Exxon Corporation | 1000.0 |

The ingredients were heated to 100° C.+10° C. and milled at a rotor speed of 230 rpm with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27. Exxon Corporation, were added. Milling was continued at a rotor speed of 330 rpm for 22 hours to obtain toner particles with an average size of 1.64 μm by area. The particulate media were removed and the dispersion of toner particles was then diluted to 2.0 percent solids with additional Isopar ®-H. To 1500 grams of this developer was added 7.5 grams of a 10% solution of purified grade lecithin (Fisher Scientific) in Isopar ®-H (Example 1-A). In Example 1-B 50 grams of 10% by weight solution of Amoco 575 in Isopar ®-H was also added. Image quality was determined using a Savin 870 copier at standard mode; charging corona set at 6.8 kv and transfer corona set at 8.0 kv using as a carrier sheet Plainwell offset enamel paper number 3 gloss 60 lb. test, Plainwell Paper Co., Plainwell, Mich. The results are shown in Table 1 below.

EXAMPLE 2

In a Union Process 1-S Attritor, Union Process Company, Akron, Ohio, was placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Quindo ® Magenta RV-6803 Mobay/Harmon | 50.0 |
| Indofast ® Brilliant Scarlet R-6300 Mobay/Harmon | 40.0 |
| Isopar ®-L, nonpolar liquid having a Kauri-butanol value of 27, Exxon Corporation | 1000.0 |
| Triisopropanolamine (TIPA) | 13.5 |

The ingredients were heated to 100° C.+10° C. and milled at a rotor speed of 230 rpm with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, was added. Milling was continued at a rotor speed of 330 rpm for 20 hours to obtain toner particles with an average size of 0.98 μm by area. The particulate media were removed and the dispersion of toner particles was then diluted to 2.0% percent solids with additional Isopar ®-H. To 1500 grams of this developer was added 45 grams of a 10% solution of Basic Barium Petronate ® oil-soluble petroleum sulfonate, Sonneborn Division of Witco Chemical Corp., New York, N.Y. in Isopar ®-H (Example 2-A). In Example 2-B was also added 35 grams of a 10% solution of Amoco 575 in Isopar ®-H. Image quality was determined as described in Example 1. The results are shown in Table 1 below.

TABLE 1

| Ex. | Charge[a] Director | Adjuvant | Additive | Resolution | Density | Transfer Efficiency | Solid Area |
|---|---|---|---|---|---|---|---|
| 1-A | Lec | EG | none | 10 | 0.75 | 58% | flow |

TABLE 1-continued

| Ex. | Charge[a] Director | Adjuvant | Additive | Resolution | Density | Transfer Efficiency | Solid Area |
|---|---|---|---|---|---|---|---|
| 1-B | Lec | EG | 575 | 10 | 1.31 | 97% | smooth |
| 2-A | BaPet | TIPA | none | 10.5 | 1.69 | 73% | flow |
| 2-B | BaPet | TIPA | 575 | 11.0 | 0.70 | 97% | smooth |

[a]Lec = lecithin
BaPet = Basic Barium Petronate ®

EXAMPLE 3

In a Union Process 1-S Attritor, Union Process Company, Akron, Ohio, was placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Heucophthal Blue G XBT-583D, Heubach, Inc., Newark, NJ | 14.9 |
| Dalamar ® Yellow pigment YT-858D Heubach, Inc., Newark, NJ | 0.15 |
| Surfynol ® 104E surfactant(1) Air Products and Chemicals, Inc. Allentown, PA | 13.3 |
| Isopar ®-L, nonpolar liquid having a Kauri-butanol value of 27, Exxon Corporation | 1000.0 |

(1)Mixture of 2,4,7,9-tetramethyl-5-decyne-4,7-diol and ethylene glycol having a specific gravity of 1.0 and a flash point (Tag open cup) >110° C.

The ingredients were heated to 100° C.±10° C. and milled at a rotor speed of 230 rpm with 0.1875 inch (4.76 mm) diameter stainless steel balls for two hours. The attritor was cooled to room temperature while the milling was continued and then 700 grams of Isopar ®-H, nonpolar liquid having a Kauri butanol value of 27, Exxon Corporation, was added. Milling was continued at a rotor speed of 330 rpm for 5.5 hours to obtain toner particles with an average size of 1.64 μm by area. The particulate media were removed and the dispersion of toner particles was then diluted to 2.0 percent solids with additional Isopar ®-H. To 2000 grams of this toner was added 31.6 grams of a 2.5% by weight solution of lecithin (Fisher Scientific) in Isopar ®-H (Example 3-A). In Example 3-B 30 grams of a 10% by weight solution of OLOA ®-1200 dissolved in Isopar ®-H was also added. Image quality was determined as described in Example 1. When Example 3-A without the OLOA ®-1200 was used the images showed good resolution, but the solid areas were marred by large droplets. These droplets represent toner poorly transferred from the selenium drum to the paper. When Example 3-B with the OLOA ®-1200 was used the toner was transferred cleanly to the paper without droplet formation.

EXAMPLE 4

The procedure in Example 3 was repeated except that the Surfynol ®104E surfactant was replaced by ethylene glycol. The toner had particle size of 1.37 μm. To 2000 grams of the 2% solution was added 25 grams of 2.5% lecithin in Isopar ®-H (Example 4-A). In Example 4-B 60 grams of a 10% solution of OLOA ®-1200 was added. When the Example 4-A without the OLOA ®-1200 was used the images showed the droplets characteristic of poor transfer. Example 4-B with OLOA ®-1200 gave images with good quality and no toner droplets in solid areas.

EXAMPLE 5

The procedure in Example 4 was repeated except that yellow pigment was omitted. The toner had particle size of 1.10 μm. Two 2000 gram samples of the 2% solution were taken. To both were added 40 grams of a 2.5% solution of lecithin in Isopar ®-H. To Example 5-B was also added 35 grams of a 10% solution of OLOA ®-1200 in Isopar ®-H. The conductivity of these Examples is given below in Table 2 below.

TABLE 2

| Example | Conductivity Initial | Conductivity One month |
|---|---|---|
| 5-A | 65 | 3 |
| 5-B | 75 | 75 |

We claim:

1. An improved electrostatic liquid developer consisting essentially of
   (A) a nonpolar liquid having a Kauri-butanol value of less than 30, present in a major amount.
   (B) thermoplastic resin particles having a plurality of fibers integrally extending therefrom and an average by area particle size of less than 10 μm.
   (C) a nonpolar liquid soluble ionic or zwitterionic compound,
   (D) a charge adjuvant taken from the group consisting of a polyhydroxy compound and an aminoalcohol compound,
   (E) a colorant, and
   (F) a polybutylene succinimide.

2. An electrostatic liquid developer according to claim 1 wherein Component (F) is OLOA ®-1200.

3. An electrostatic liquid developer according to claim 1 wherein Component (F) is Amoco 575.

4. An electrostatic liquid developer according to claim 1 wherein Component (F) is present in an amount of 5 to 500 mg/g of developer solids.

5. An electrostatic liquid developer according to claim 1 wherein the thermoplastic resin is a copolymer of ethylene and an α,β-ethylenically unsaturated acid selected from the class consisting of acrylic acid and methacrylic acid.

6. An electrostatic liquid developer according to claim 1 wherein the thermoplastic resin is an ethylene vinyl acetate copolymer.

7. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

8. An electrostatic liquid developer according to claim 7 wherein the thermoplastic resin is a copolymer of ethylene (89%)/methacrylic acid (11%) having a melt index at 190° C. of 100.

9. An electrostatic liquid developer according to claim 1 wherein the particles have an average by area particle size of less than 5 μm.

10. An electrostatic liquid developer according to claim 1 wherein component (C) is Basic Barium Petronate.

11. An electrostatic liquid developer according to claim 1 wherein component (C) is lecithin.

12. An electrostatic liquid developer according to claim 1 wherein component (D) is a polyhydroxy compound.

13. An electrostatic liquid developer according to claim 1 wherein component (D) is an aminoalcohol compound.

14. An electrostatic liquid developer according to claim 13 wherein the aminoalcohol is triisopropanolamine.

15. An electrostatic liquid developer according to claim 1 containing about 1% to about 60% by weight of a colorant based on the total weight of developer solids.

16. An electrostatic liquid developer according to claim 15 wherein the colorant is a pigment.

17. An electrostatic liquid developer according to claim 16 wherein the pigment is present an amount of 1% to 30% by weight based on the total weight of developer solids.

18. An electrostatic liquid developer according to claim 15 wherein the colorant is a dye.

19. An electrostatic liquid developer according to claim 1 wherein a fine particle size oxide is present.

20. An improved electrostatic liquid developer consisting essentially of:

(A) a nonpolar liquid having a Kauri-butanol value of less than 30, 85.0 to 99.9% by weight based on the weight of the developer;

(B) particles having an average by area particle size less than 10 μm of a copolymer of ethylene (89%)/methacrylic acid (11%) having a melt index at 190° C. of 100 wherein a plurality of fibers integrally extend from said particles:

(C) Basic Barium Petronate, 1 to 1000 mg/g developer solids;

(D) ethylene glycol, 1 to 1000 mg/g developer solids;

(E) a black cyan, magenta or yellow colorant, 1 to 60% by weight based on the total weight of developer solids; and (F) polybutylene succinimide, 5 to 500 mg/g developer solids, the total weight of developer solids being 0.1 to 15% by weight of the developer.

21. An electrostatic liquid developer according to claim 20 wherein Basic Barium Petronate is replaced with a like amount of lecithin.

22. An electrostatic liquid developer according to claim 20 wherein the ethylene glycol is replaced with a like amount of triisopropanolamine.

* * * * *